US011623673B2

(12) United States Patent
Kälberer et al.

(10) Patent No.: US 11,623,673 B2
(45) Date of Patent: Apr. 11, 2023

(54) METHOD FOR SAFELY AND AUTONOMOUSLY DETERMINING THE POSITION INFORMATION OF A TRAIN ON A TRACK

(71) Applicant: Thales Management & Services Deutschland GmbH, Ditzingen (DE)

(72) Inventors: Ulrich Kälberer, Stuttgart (DE); Harald Bauer, Backnang (DE); Pierre Le Maguet, Stuttgart (DE)

(73) Assignee: Thales Management & Services Deutschland GmbH, Ditzingen (DE)

( * ) Notice: Subject to any disclaimer, the term of this patent is extended or adjusted under 35 U.S.C. 154(b) by 236 days.

(21) Appl. No.: 16/844,746

(22) Filed: Apr. 9, 2020

(65) Prior Publication Data

US 2021/0094595 A1 Apr. 1, 2021

(30) Foreign Application Priority Data

Apr. 12, 2019 (EP) ..... 19168971

(51) Int. Cl.
*B61L 25/04* (2006.01)
*B61L 25/02* (2006.01)

(52) U.S. Cl.
CPC ..... *B61L 25/04* (2013.01); *B61L 25/025* (2013.01); *B61L 2205/04* (2013.01)

(58) Field of Classification Search
CPC .... B61L 25/04; B61L 25/025; B61L 2205/04; B61L 23/34; B61L 23/00; B61L 23/041;
(Continued)

(56) References Cited

U.S. PATENT DOCUMENTS

2008/0161987 A1* 7/2008 Breed ..... G08G 1/161 701/27
2008/0231506 A1* 9/2008 Stull ..... B61L 3/125 342/357.33

(Continued)

FOREIGN PATENT DOCUMENTS

CN 1361433 A 7/2002
CN 106218673 A 12/2016

(Continued)

*Primary Examiner* — Hai Phan
*Assistant Examiner* — Anthony D Afrifa-Kyei
(74) *Attorney, Agent, or Firm* — Orbit IP

(57) ABSTRACT

A method for safely determining a position information of a train on a track includes an on-board system determining appearance characteristics, current distances relative to the train and current angular positions relative to the train of passive trackside structures with a first sensor arrangement of a first localization stage of the on-board system. The on-board system stores a map data base in which georeferenced locations and appearance characteristics of the passive trackside structures are registered. A first position information about the train is derived from a comparison of determined current distances and current angular positions and the registered locations of allocated passive trackside structures by the first localization stage. A second position information about the train is derived from satellite signals determined by a second sensor arrangement of a second localization stage. The first and second position information undergo a data fusion resulting in a consolidated position information.

23 Claims, 8 Drawing Sheets

(58) Field of Classification Search
CPC ..... B61L 27/04; G06V 20/10; G06V 20/56; G06V 20/582; G06V 20/70; B60W 30/00; G01C 21/20; G05B 15/02; G05D 1/021; G06T 19/003
See application file for complete search history.

(56) References Cited

U.S. PATENT DOCUMENTS

| | | | | |
|---|---|---|---|---|
| 2010/0063734 | A1* | 3/2010 | Kumar | B61L 25/026 701/300 |
| 2010/0312461 | A1* | 12/2010 | Haynie | B61L 25/026 701/117 |
| 2012/0326924 | A1* | 12/2012 | Kanner | G01S 19/11 342/357.31 |
| 2016/0221592 | A1 | 8/2016 | Puttagunta et al. | |
| 2017/0066459 | A1* | 3/2017 | Singh | G06K 9/6215 |
| 2017/0113707 | A1* | 4/2017 | Ghaly | B61L 23/18 |
| 2017/0148323 | A1* | 5/2017 | Shubs, Jr. | B61L 27/10 |
| 2018/0057030 | A1 | 3/2018 | Puttagunta et al. | |

FOREIGN PATENT DOCUMENTS

| | | | |
|---|---|---|---|
| CN | 107340407 | A | 11/2017 |
| CN | 107533630 | A | 1/2018 |
| CN | 110304112 | A | 10/2019 |
| GB | 2501596 | A | 10/2013 |
| WO | 2016/118672 | A2 | 7/2016 |

* cited by examiner

METHOD FOR SAFELY AND AUTONOMOUSLY DETERMINING THE POSITION INFORMATION OF A TRAIN ON A TRACK

CROSS-REFERENCE TO RELATED APPLICATIONS

This application claims priority to European Patent Application EP 19 168 971.0 filed on Apr. 12, 2019, the entire contents of which are fully incorporated herein with this reference.

DESCRIPTION

Field of the Invention

The invention relates to a method for safely determining a position information of a train on a track, wherein an on-board system of the train identifies trackside structures.

Background of the Invention

State of the art is train position determination by discrete position beacons and odometry. National embodiments of these position beacons are for example EURO-Balises as standardized for the ETCS (European train control system).

When operating trains on the tracks of a railway network, an information required by the movement authority is the current position of every train moving in the railway network. The movement authority requires this information, in particular, for avoiding train collisions. Information about a current train position is also key for autonomous train operation ("driverless driving of a train").

In ETCS, a train position information is based on balises which are installed along the track. Balises are transponders, which receive radio signals emitted by an antenna of an on-board system installed on a bypassing train, and which in turn answer by emitting radio signals containing some information relevant for the train operation, e.g. a balise identification code. It should be noted that some types of balises have their own energy supply, and other types of balises do not have an own energy supply, but instead use the energy provided by the antenna installed on the train.

A train passing over a balise counts the driven distance since having passed the balise by odometry, and can in this way determine its current position by "adding" the driven distance of the train to the known balise reference position. Each time a new balise is passed, the count of the driven distance of the train is reset.

This procedure requires the installation of active trackside structures, i.e. the balises, all along the track the train passes. The balises take an active part in determining the train position, since they generate a radio signal answer upon receipt of a triggering radio signal of the train ("technical reaction"); note that this active part is independent of the type of energy supply of the balise. Accordingly, a balise requires dedicated technical equipment (in particular electrical circuits), which has to be manufactured, installed and maintained for each balise, which is cumbersome and expensive, in particular if the railway network is extended.

SUMMARY OF THE INVENTION

Objective of the Invention

It is the objective of the present invention to provide a method for determining a position information of a train, which is less cumbersome and less expensive in installation and operation, however provides an equivalent level of safety compared to state-of-the-art train positioning methods.

Short Description of the Invention

This objective is achieved, in accordance with the invention, by a method as introduced in the beginning, characterized in that the trackside structures comprise passive trackside structures which are passive in their identification by the on-board system, wherein the on-board system determines appearance characteristics, current distances relative to the train and current angular positions relative to the train of the passive trackside structures by means of a first sensor arrangement of a first localization stage of the on-board system, wherein the on-board system stores a map data base in which georeferenced locations and appearance characteristics of the passive trackside structures are registered, wherein the first localization stage allocates passive trackside structures measured by the first sensor arrangement to passive trackside structures registered in the map data base using the determined appearance characteristics and the registered appearance characteristics, that a first position information about the train is derived from a comparison of determined current distances and current angular positions and the registered locations of allocated passive trackside structures by the first localization stage, that a second position information about the train is derived from satellite signals determined by a second sensor arrangement of a second localization stage of the on-board system, and that the first position information and the second position information undergo a data fusion, resulting in a consolidated position information about the train.

Train positioning by means of satellite navigation, preferably combined with SBAS augmentation, provides a certain safety level. Independently, train position determination on the basis of imaging methods provide also a certain safety level. Combination of both techniques meets a superior safety level, in particular the safety level for ETCS, that none of the said techniques is able to achieve on its own. As mitigation for each systematic failure mode, a monitoring method may be applied for excluding erroneous data. For statistical reliability model, the failure probability of the two independent stages can be multiplied, representing both systems fail simultaneously. Given adequate sensor and device failure rates, the consolidated position information failure probability is smaller than the tolerable hazard rate. Hence, the backbone for the safety achievement in accordance with the invention are two independent localization stages based on dissimilar, orthogonal sensors and dissimilar processing techniques.

The invention allows an autonomous determination of the positon information of the train on the track. The invention does not require a cooperation of the on-board unit with active trackside structures (such as balises), but merely requires the existence passive trackside structures, which only have to expose themselves (in particular their outer appearance) to the first localization stage or their first sensor arrangement, respectively. More specifically, the passive trackside structures need not comprise a dedicated technical equipment (such as an electrical circuit), such as for actively generating a radio signal answer to a triggering radio signal of the on-board unit system. Passive trackside structures for the inventive method may comprise, for example, rail infrastructure elements, including signals and signs, buildings, in particular train stations, or bridges, in particular bridges spanning over the track, or signal masts, or crossing roads, or traffic signs, or switches.

The first localization stage (comprising the first stage sensor arrangement), which is based on identifying said passive trackside structures along the track and comparing them with registered (known and expected) passive trackside structures stored in a map data base of the on-board unit, provides an environmental localization information. The second localization stage (comprising the second stage sensor arrangement), which is based on satellite signals, in particular code and carrier ranging signals and navigation orbit data broadcasted by GPS, Galileo, GLONASS and/or Beidou satellites, provide a geodetic localization information. By using both pieces of information in a data fusion, a particular high integrity level of a consolidated position information is achieved and output to the train management system or train control system.

A (first, second or consolidated) position information typically includes a (best estimate) location expressed in geodetic coordinates and/or an along track driven distance since a last reference point (which may be the registered location of a particular passive trackside structure), and typically a corresponding confidence indication, and typically also a train orientation with attitude angles (heading, roll, pitch).

The first position information is typically computed by the geolocation of the registered passive structures and the measured distance and angular relations to one or a plurality of passive structures. Typically, the first sensor arrangement determines a passive trackside structure at some distance (i.e. when the train is still said distance away from the structure), and by way of the measured distance and the angular relations (such as the elevation angle and the azimuthal angle), together with the registered geolocation of a corresponding allocated passive trackside structure in the stored map data base can calculate the train position information.

Data fusion (or data consolidation) comprises, in the most simple case, a comparison of the difference of the first position information and the second position information, and if the mutual deviation is smaller than a (typically statistically determined) threshold level, the more accurate position information is used as consolidated position information (often the first position information). If the mutual deviation is at or above the threshold level, the more reliable information is used as consolidated position information (often the second position information).

Preferred Variants of the Invention

A preferred variant of the inventive method provides that the consolidated position information also comprises a consolidated train velocity, and preferably further a corresponding velocity confidence interval and velocity angle components such as up, north, east, that the first sensor arrangement and/or the second sensor arrangement comprises one or a plurality of an inertial unit, a doppler radar system or an odometer, and that the first position information and the second position information comprise a first train velocity and a second train velocity respectively, and that the data fusion includes determining the consolidated train velocity. The train velocity is an information valuable for the movement authority and for autonomous train operation. Velocity can be derived from a recent history of train location (which is part of the first and second position information). An inertial unit may determine an acceleration. Doppler radar may access velocity directly. Odometer allows a determination of driven distance, and recent history of odometer measurements also allows determining train velocity. Sensor results of inertial unit, Doppler radar and/or odometer may be used for data crosschecks, which increase the data integrity.

Further preferred is a variant wherein the first sensor arrangement comprises one or more optical imaging sensors, in particular a video sensor and/or a LIDAR sensor, preferably wherein the first sensor arrangement further comprises one or a plurality of inertial unit, radar system or odometer. Optical imaging sensors allow an inexpensive and non-hazardous observation of the surroundings at a high level of detail, so a good quality of determination of appearance characteristics of the passive trackside structures is possible. Typically, the first sensor arrangement comprises a pair of optical sensors for stereo view, allowing determination of current distances and current angular positions. If multiple localization chains are used in the first localization stage, a pair of optical sensors is used per localization chain or first sensor subarrangement, respectively, wherein the pairs of optical sensors are of different type and independent from each other. Preferably at least two diverse independent optical sensors are used that operate in the visible light regime and the infrared regime, respectively. The optical imaging sensors may be supported by headlights installed on the train, illuminating the passive trackside structures with visible and/or IR light radiation. An inertial unit allows a direct acceleration determination, Doppler radar a direct velocity determination, and odometer allows a measurement of driven distance.

Further advantageous is a variant wherein the second sensor arrangement comprises one or more GNSS-SBAS RX sensors, and preferably wherein the second sensor arrangement further comprises one or a plurality of inertial unit, radar system or odometer. These systems have been proven reliable with a high level of safety in practice. Note that GNSS stands for global navigation satellite system (e.g. GPS or GALILEO), and SBAS stands for satellite based augmentation system (such as WAAS or EGNOS), and RX stands for receiver. The navigation satellite receiver sensors measure pseudorange code and carrier to and receive navigation data from satellites, preferably of at least two diverse navigation systems such as GPS and GALILEO in order to establish two independent localization chains.

Particularly preferred is a variant characterized in that the first localization stage comprises at least two independent localization chains with separate first sensor subarrangements, with each localization chain providing an independent set of appearance characteristics, current distance and current angular position for a respective passive trackside structure, wherein for each set, a separate allocation to registered passive trackside structures is done and an independent first stage position subinformation is derived, and that the second localization stage comprises at least two independent localization chains with separate second sensor subarrangements, with each localization chain providing an independent second stage position subinformation about the train, in particular wherein each chain includes a monitoring function that detects chain failure modes. So in total, four localization chains independently determine position subinformation about the train, so an even higher data integrity level of the consolidated position information may be achieved.

In a preferred further development of this variant, the data fusion comprises a first step with fusion or consolidation of the position subinformation of each one localization stage separately, in order to obtain the first and second position information, and a second step with fusion of the first and second position information to obtain the consolidated position information. Note that alternatively, a one step data fusion could be applied, wherein all pieces of position subinformation are united into the consolidated position information at once.

A preferred variant of the inventive method provides that the passive trackside structures used in position determination are chosen such that the allocation the of passive trackside structures measured by the first sensor arrangement to the registered passive trackside structures is accomplished with a confidence above a predefined threshold value, wherein for passive trackside structure recognition an initial position is used to select from the map data base expected ahead structures to be recognized, with an expected structure type and an expected angular position as well as an expected distance, which are used, together with a recent history of allocated passive trackside structures, as a matching constraint for allocating the measured trackside structures to the registered trackside structures, and preferably whereas in case no specific trackside structures are expected or have been tracked in the recent history, generic passive structures that are stored as templates are used to be matched. By a pre-selection of expected structures from the stored map database, recognition and allocation of passive trackside structures measured (determined) with the first sensor arrangement is made safer. Further, passive trackside structures with unique appearance, i.e. having an appearance that is rarely seen in other objects, improve recognition and allocation robustness.

In another preferred variant, the on-board system reports the consolidated position information as train position report message to a supervision instance allocating track routes to trains, wherein the supervision instance uses a supervision map data base for said allocating track routes to trains, and wherein the on-board system map data base is regularly synchronized with the supervision map data base with respect at least to its content necessary for determining position of the train. By regular synchronization, the supervision instance (or movement authority) supplies up-to-date and safe map information. Both the supervision instance and the on-board unit of the train use the same information for determining and monitoring the train position, in particular the locations of passive track structures or other reference points used in defining train position.

An advantageous further development of this variant provides that after the consolidated position information of the train has been determined, the train evaluates locations of passive trackside structures sensed by the first sensor arrangement, and determines discrepancies between the locations sensed by the first sensor arrangement and expected locations according to the map data base stored in the on-board system, and reports determined discrepancies above a threshold to the supervision instance, that the supervision instance collects reported determined discrepancies from a plurality of trains, and that in case a determined discrepancy referring to a passive trackside structure is reported by a plurality of trains, the supervision instance updates its supervision map data base after a successful validation process, and the map data base stored in the on-board system is synchronized with the supervision map data base. By this means, both the supervision map data base and the map data based stored in the on-board unit can be kept up to date in a safe way, and consolidated position information of trains can be obtained with a high data integrity. Note that once a (supervision) map data base of high quality has been prepared, determined discrepancies are typically due to physical changes in the registered passive trackside structures, such as if a rail infrastructure has been rebuilt.

In a highly preferred variant, sensor data of the first sensor arrangement and/or second sensor arrangement and/or first position information and/or second position information and/or first stage position subinformation and/or second stage position subinformation undergo a monitoring for fault cases, including a check against expected value ranges from statistical error models, and preferably also a crosschecking of first and second stage position subinformation of each stage. In this way, a high safety level of the positioning method may be achieved. By applying monitoring for fault cases and crosschecks on the dissimilar sensor data and the dissimilar data processing, unreliably pieces of information can be identified and ignored, and the consolidated position information of the train may be based on the remaining pieces of more reliable information.

In a preferred further development of this variant, sensor data of the second sensor arrangement undergo said monitoring for fault cases in satellite measurements, in particular multipath errors, ionospheric propagation and/or satellite defects, by comparing code and carrier measurements or by comparing satellite measurements against projected value innovations. A plurality of satellite navigation fault cases are mitigated for example by appyling the SBAS augmentation data, and therefore here a strong increase in data integrity of position information of a train can be achieved. The stored map data base may contain information about blocked elevation angle intervals as a function of the (estimated current) location, and signals of satellites that are expected to appear in a blocked elevation angle interval are discarded for expected multipath corruption. Alternatively or in addition, multipath threats can be determined online by using the first sensor arrangement, in particular optical imaging sensors or LIDAR sensors, which identifies potentially blocking and/or reflecting objects close to the track, and signals of satellites that are expected to appear in a blocked elevation angle interval or which appear in a position that allows one or a plurality of indirect signal paths in addition to a direct signal path are discarded for expected multipath corruption.

Another preferred further development provides that said monitoring comprises consistency checks of the second localization stage between redundant satellite ranging measurements, and that a track trajectory included in the map data base stored in the on-board system is used as a constraint, such that an alongtrack 1D position information of the train is obtained from a pair of 2 satellites, and consistency of a multitude of pairs of 2 satellites are checked, in particular wherein the monitoring applies an autonomous integrity monitoring type algorithm. By using only 2 satellites in each position determination (instead of 4 satellites in the general 3D case), the number position solutions resulting from satellite pairing permutations allows for a larger number of consistency checks and statistical evaluations, that can be made with the same total amount of visible satellites, and thus allowing a higher integrity level of position information determination.

Further preferred is a variant wherein the consolidated position information about the train includes a 1D confidence interval along its track. This is a simple measure of determining the reliability of the position information, here with respect to location, which can be used directly by a supervision instance (movement authority).

Further preferred is a variant wherein the first localization stage uses information from the on-board map data base in order to predict an upcoming passive trackside structure, in particular by means of a Kalman filter, and in order to choose accordingly a limited field of interest out of the sensor data of the first sensor arrangement in order to facilitate finding said passive trackside structure. This is a simple and efficient way for accelerating and improving reliability of recognition and allocation of passive trackside structures. In particular, by this variant, tracking passive trackside structures with a known train trajectory can be improved. By limiting the field of interest, typically to a part of the area covered by an optical imaging sensor, recognition and tracking algorithms have to process less data what accelerates the processing, or allows more sophisticated processing in the same time.

A particularly preferred variant used for track selection monitoring provides that in case the map data base stored in the on-board system shows a number of tracks in a defined near vicinity of the train, then a heading angle and heading angle change of the train as measured by the first sensor arrangement is compared with a number of candidate heading angles and heading angle changes of the train calculated by means of the map data base for the train being on each of said number of tracks, that the candidate heading angle and heading angle change with the best match with the heading angle and heading angle change measured by the first sensor arrangement is determined, that the consolidated position information is used to indicate one of the tracks of said number of tracks on which the train is travelling, and that in case that said track indicated by the consolidated position information is identical with said track having the best match, the consolidated position information is validated, and else invalidated. Comparing the heading angle (typically expressed as the orientation of the train or its locomotive, respectively, with respect to the "north" direction) and the heading angle change of the train with the candidate heading angles allows an increase in position information reliability in a particular critical situation, namely when the used track of a train out of a number of typically closely neighbouring candidate tracks has to be determined. For monitoring of the track selection, the track heading information expressed by heading angle and heading angle change is used as signature properties for the matching method.

Further advantages can be extracted from the description and the enclosed drawing. The features mentioned above and below can be used in accordance with the invention either individually or collectively in any combination. The embodiments mentioned are not to be understood as exhaustive enumeration but rather have exemplary character for the description of the invention.

DETAILED DESCRIPTION OF THE PREFERRED EMBODIMENTS

1. Overview of the Invention

The invention relates to a method for determining a position information of a train on a track of a railway system. In accordance with the invention, two localization stages are employed for position determination. By means of a first localization stage, the environment of the train, in particular the viewed environment ahead of the train, is analysed and compared to the contents of a stored map data base. By identifying passive trackside structures in the environment, which are registered in the stored map data base, a first position information about the train is derived. By means of a second localization stage, satellite navigation is applied in order to derive a second position information about the train. By a data fusion of the first and second position information, a consolidated position information about the train is obtained, which may be used for example by a movement authority to allocate tracks to trains running in the railway system or for autonomous driving operation.

Figure 1:
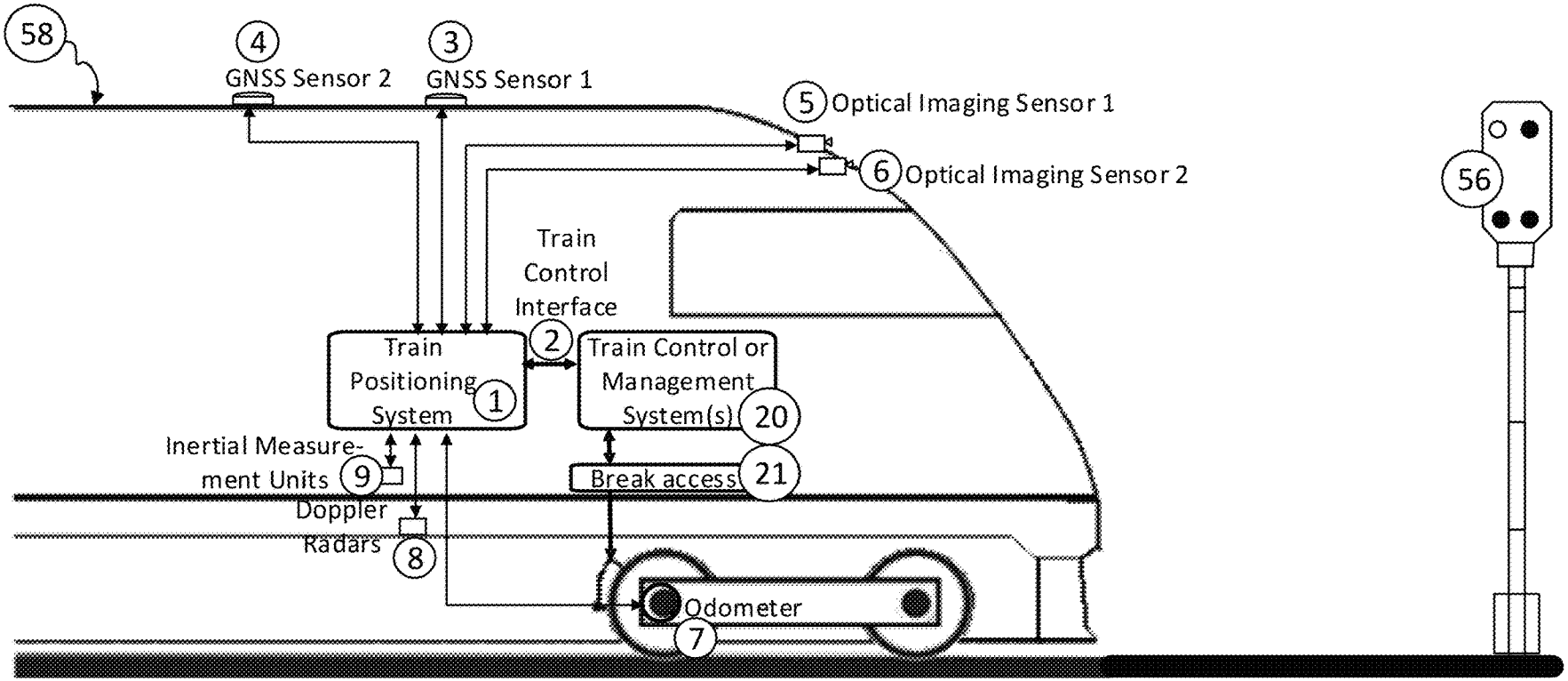
FIG. 1 shows a schematic illustration of a train, equipped for the inventive method.

FIG. 1 illustrates a train 58, here the locomotive (or front wagon) of the train 58, equipped for performing the inventive method by way of example.

The train 58 comprises an on-board train positioning system (also simply called on-board system) 1, which provides (generates) a consolidated position information about the train. This consolidated position information may be provided via a train control interface 2 to a train control management system (or systems) 20, which for example has a break access 21 for triggering emergency stops.

The on-board train positioning system (on-board system) 1 receives sensor data from a plurality of sensors, in the example shown form a first GNSS sensor 3 and a second GNSS sensor 4, a first optical imaging sensor 5 and a second optical imaging sensor 6, further from an odometer 7, Doppler radars 8 and inertial measurement units 9. At least some of the sensors (here the optical imaging sensors 5, 6) search for and measure passive trackside structures 56 ahead of the train 58, in particular with respect to their appearance characteristics (external shape), their distance to the train 58 and their angular position relative to the train 58; here a signal mast is shown as an example for such a passive trackside structure 56. The sensor data is processed an analysed according to the invention by the on-board train position system (on-board system) 1 for calculating or generating the consolidated position information of the train 58.

Figure 2A:
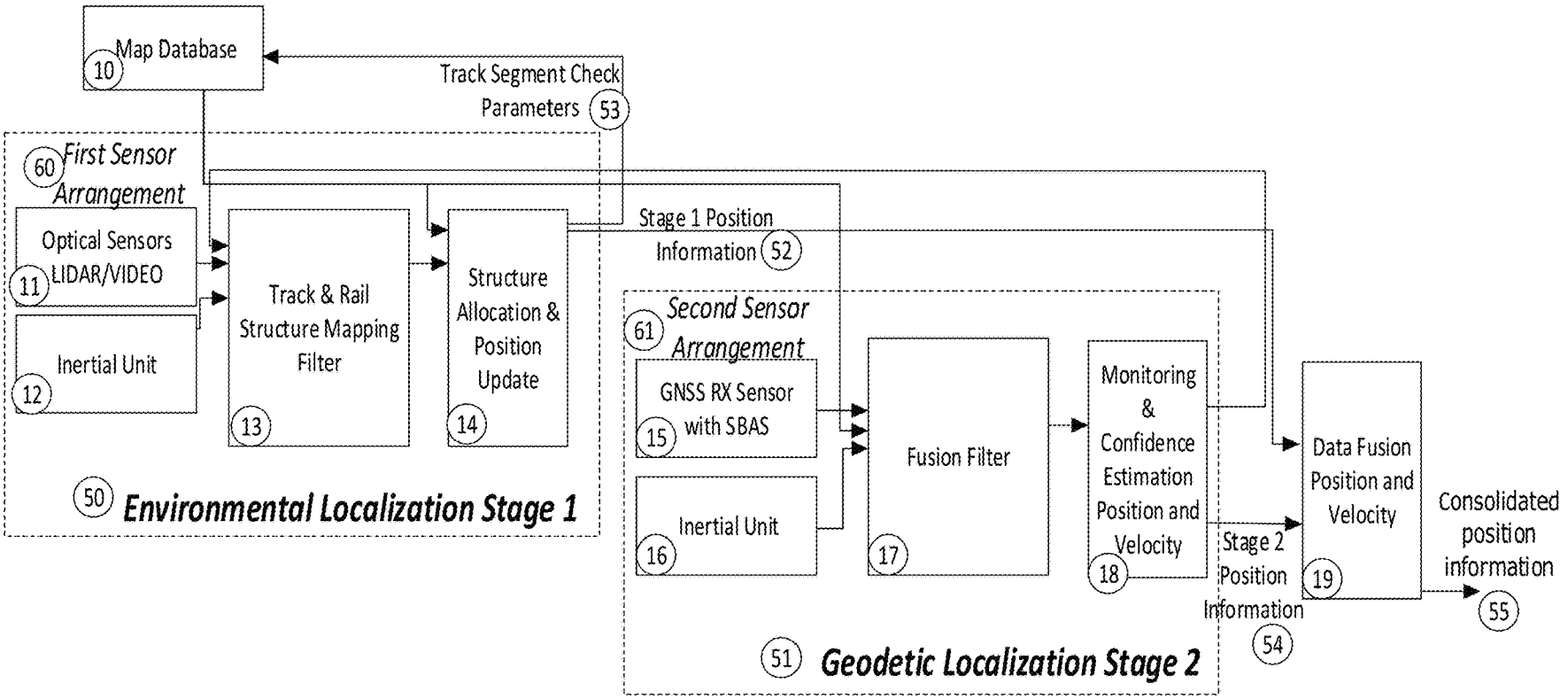
FIG. 2*a* shows a schematic flow diagram of a first variant of the inventive method.

The processes involved in obtaining the consolidated position information by means of the on-board unit is illustrated in a first variant in FIG. 2*a*.

According to the invention, a first localization stage (also called environmental localization stage 1) 50 is established, which processes sensor data from a first sensor arrangement 60. This first sensor arrangement 60 here comprises optical sensors 11 comprising both LIDAR and a VIDEO sensors, as well as a an inertial unit 12. Their sensor data is here fed into a track and rail structure mapping filter 13. Said filter 13 has access to an on-board map database 10, storing in particular information about known passive trackside structures including their georeferenced locations and their appearance characteristics (i.e. their visible shape). By means of the information from the map database 10, particular passive trackside structures can be expected in the sensor data in particular parts (e.g. view areas) of the sensor data, and the sensor data is analysed in a dedicated way in order to quickly and reliably find these trackside structures at these particular parts. When one or a plurality of passive trackside structures have been found (recognized) in the sensor data, the corresponding passive trackside structure or structures stored in the map database 10 are allocated 14. Further, from the georeferenced stored location of an allocated passive trackside structure and the current distance and current angular position of the identified passive trackside structure in the sensor data, the current position of the train can be calculated or updated, resulting in a stage 1 position information (also simply called first position information) 52. Note that when for some time no passive trackside structure can be identified, the first position information 52 can be derived from a last available first position information, interpolated by a last available speed information and acceleration information from the inertial unit 12; such an interpolation can also be used for checking the reliability of a position update by a (in particular newly recognized) passive trackside structure.

In the variant shown, the first position information 52 or the result of the structure allocation and position update 14, respectively, is also used for providing track segment check parameters 53, which are compared with information of the map database 10.

Note that at least via the history of first position information 52, the first position information also includes a velocity information, in addition to a location information.

Further, a second localization stage (also called geodetic localization stage 2) 51 is established, which processes sensor data from a second sensor arrangement 61. This second sensor arrangement 61 here comprises a GNSS RX Sensor 15 as well as an inertial unit 16. Their sensor data is here fed into a fusion filter 17. Said filter 17 has access to the map database 10, storing in particular information about available tracks of the train; this can be used as a constraint in position determination. The fusion filter 17 consolidates the sensor data or their corresponding position information. Note that in the fusion filter, a velocity information can be derived, in addition to a location information. Via a last available location information and using a last available speed information and acceleration information from the inertial unit 17, also a speed information may be derived. The second localization stage 51 also includes a monitoring and confidence estimation for position (including location and velocity) 18, and results in a stage 2 position information (also simply called second position information) 54. It should be noted that the stage 2 position information 54, and in particular the confidence estimation, may be used as an input for the trail and track structure mapping filter 13 in the first localization stage 50.

Finally, the first position information 52 and the second position information 54 undergo a data fusion 19 with respect to position (including location and velocity), resulting in a consolidated position information 55. This consolidated position information 55 contains a location information (typically as a driven distance since a last reference point on a track segment of the railway system, and/or a georeferenced location) as well as a velocity information (typically as an alongtrack speed, and/or categorized by velocity components in particular directions), and corresponding confidence intervals.

Figure 2B:
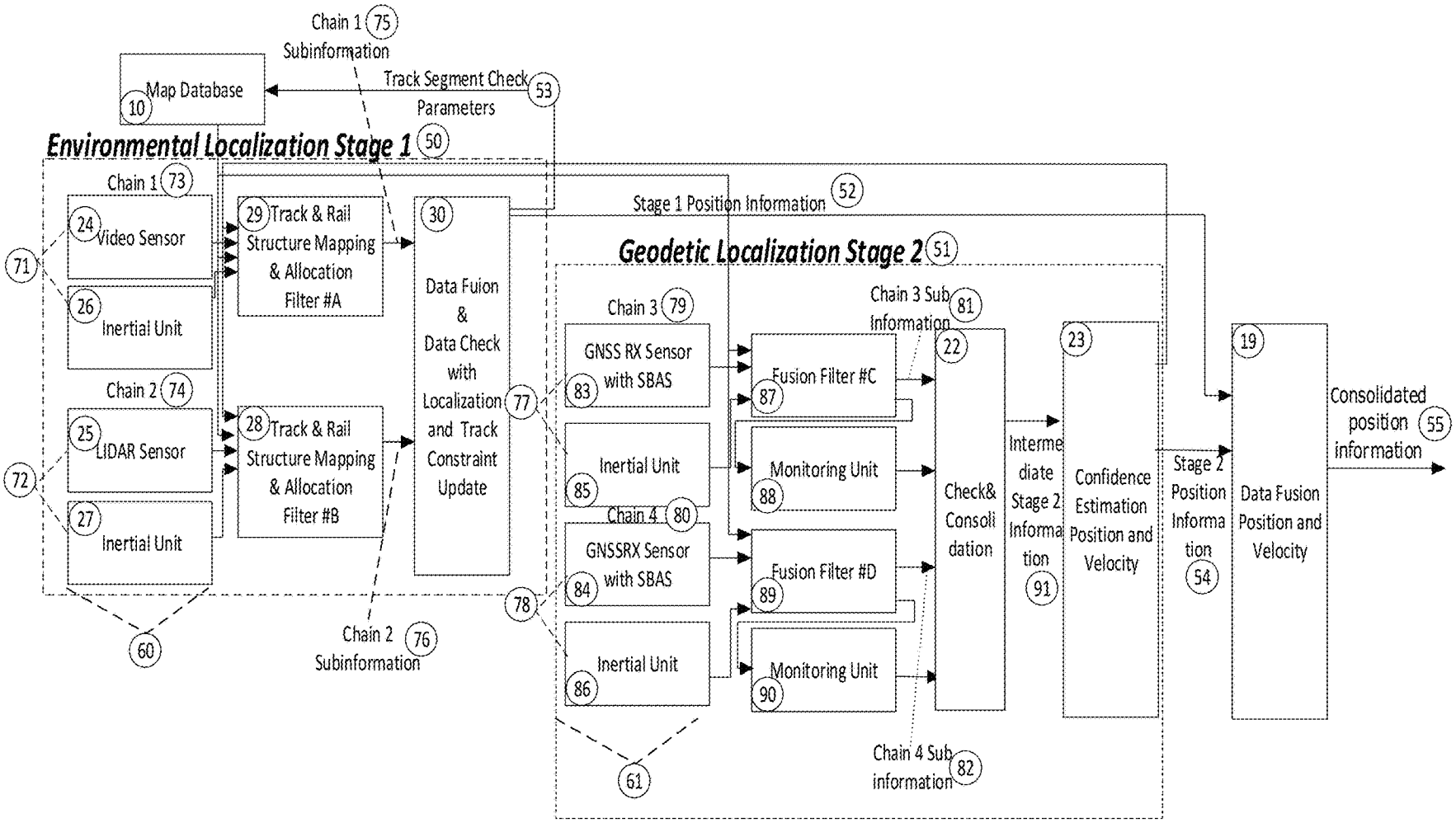
FIG. 2*b* shows a more detailed schematic flow diagram of a second variant of the inventive method, with the first localization stage comprising two independent localization chains and the second localization stage comprising two separate localization chains.

The processes involved in obtaining the consolidated position information by means of the on-board unit is further illustrated in a second variant in FIG. 2*b*; note that only the major differences with respect to the first variant shown in FIG. 2*a* are explained in detail.

In this variant, the first localization stage (also called environmental localization stage 1) 50 processes sensor data originating from a first sensor arrangement 60 comprising two localization chains 73, 74, here also referred to as chain 1 and chain 2. First chain 73 comes along with a first sensor subarrangement 71, consisting here of a video sensor 24 and an inertial unit 26. Second chain 74 comes along with another first sensor subarrangement 72, consisting here of a LIDAR sensor 25 and another inertial unit 27. Sensor signals from the sensors 24, 26 of the first chain 73 are fed into a track and rail structure mapping and allocation filter #A 29, which provides a first stage position subinformation (also called chain 1 subinformation) 75; note that information from the map database 10 is taken into account for filtering purposes here. Likewise, sensor signals for the sensors 25, 27 of the second chain 74 are fed into another track and rail structure mapping and allocation filter #B, which provides another first stage position subinformation (also called chain 2 subinformation) 76; note again that information form the map database 10 is taken into account for filtering purposes here.

The two pieces of first stage position subinformation 75, 76 then undergo a data fusion and a data monitoring with localization and track constraint update 30, resulting in a first position information (also called stage 1 position information) 52.

It should be noted that the two localization chains 73, 74 and the corresponding two pieces of first stage position subinformation 75, 76 are independent from each other, in particular as far as sensing and allocation of passive structures are concerned.

Further, the second localization stage (also called geodetic localization stage 2) 51 processes sensor data originating from a second sensor arrangement 61 comprising two localization chains 79, 80, here referred to as chain 3 and chain 4. Third chain 79 comes along with a second sensor subarrangement 77, consisting here of a GNSS RX sensor with SBAS 83 and an inertial unit 85. Second chain 80 comes along with another second sensor subarrangement 78, consisting here of another GNSS RX Sensor with SBAS 84 and another inertial unit 86. Sensor signals from the sensors 83, 85 of the third chain 79 are fed into a fusion filter #C 87, which provides a second stage position subinformation (also called chain 3 subinformation) 81; note that information from the map database 10 may be taken into account here. Likewise, sensor signals for the sensors 84, 86 of the fourth chain 80 are fed into a fusion filter #D 89, which provides another second stage position subinformation (also called chain 4 subinformation) 82; note again that information form the map database 10 is taken into account here.

The operation of fusion filter #C 87 is monitored (checked) by a monitoring unit 88, and the operation of fusion filter #D 89 is monitored (checked) by monitoring unit 90. The two pieces of second stage position subinformation 81, 82 as well as the monitoring results from monitoring units 88, 90 undergo a consolidation 22, providing intermediate stage 2 information 91. This is followed by a confidence estimation 23 of the position (including location and velocity), which results in the second position information (also called stage 2 position information) 54. Note that the stage 2 position information 54 or the results of the confidence estimation 23 of position, respectively, may be used as an input for the track and rail structure mapping and allocation filters 29, 28.

It should be noted that the two localization chains 79, 80 and the corresponding two pieces of second stage position subinformation 81, 82 are independent from each other, in particular as far as reception of satellites are concerned; note that the GNSS RX sensors 83, 84 are preferably located at significantly different positions on the train, but with a fixed relative position of each other. For example, the GNSS RX sensors 83, 84 can be placed one at the front and one at the back of a particular train segment, such that there is a rigid mechanical structure linking them. Then a frequent satellite fault case, namely multipath errors, occurs at different points of time at the different sensors 83, 84, so in general, not both of them are faulted for the same reason.

Finally, the first position information 52 and the second position information 54 undergo a data fusion 19 with respect to position (including location and velocity), resulting in a consolidated position information 55. Again, this position information contains a location information (typically as a driven distance since a last reference point on a track of the railway system, and/or a georeferenced location) as well as a velocity information (typically as a speed on the track, and/or categorized by velocity components in particular directions), and corresponding confidence intervals.

Figure 4:
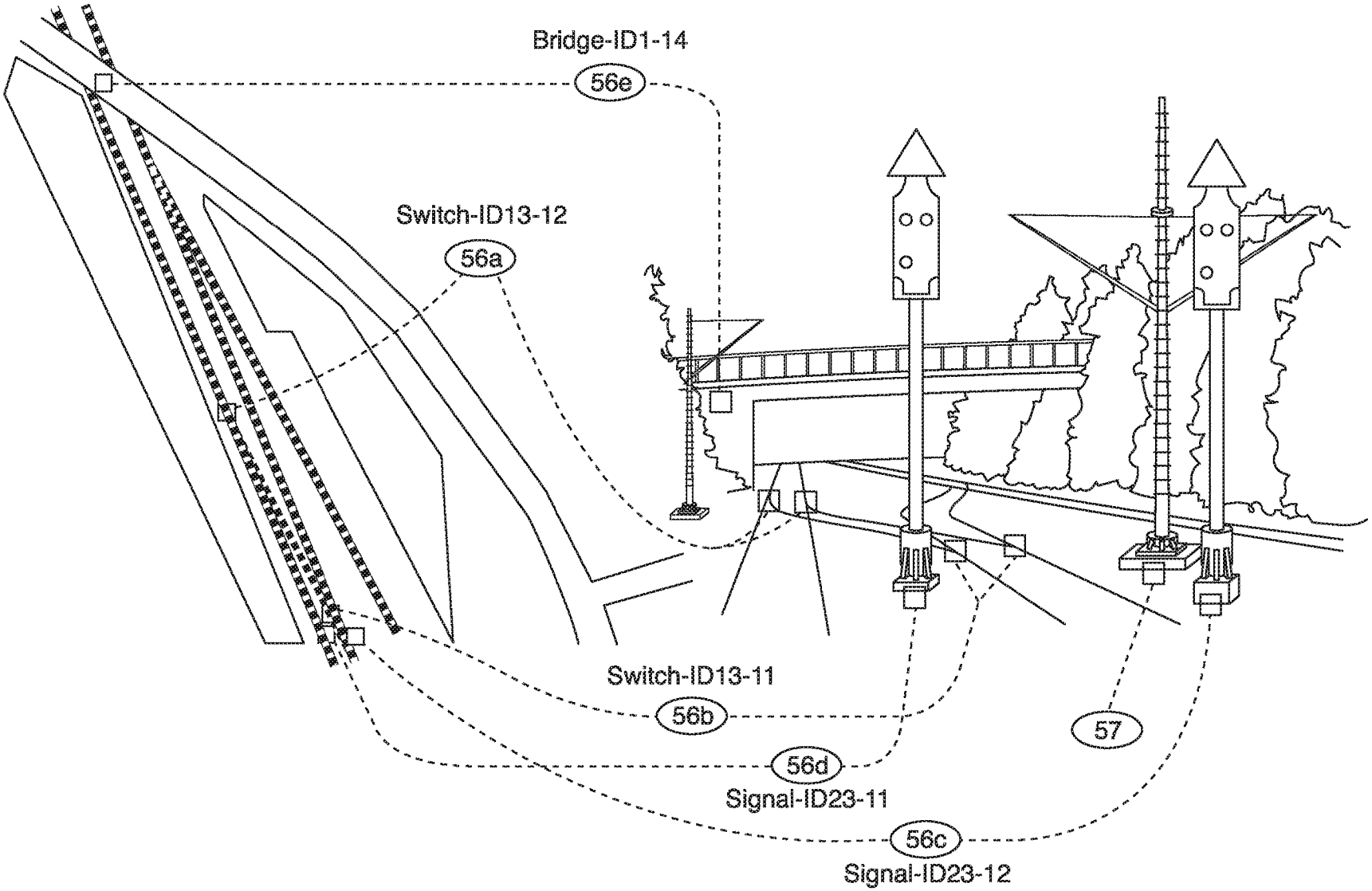
FIG. 4 shows a schematic illustration of front view from a train heading as sensed by an optical sensor, comprising several passive trackside structures, and their allocation to an on-board map database, in accordance with the invention.

FIG. 4 illustrates a typical front view from a train during the inventive method by way of example. Optical imaging sensors installed on the train measure the heading, which is illustrated on the right hand side of FIG. 4. Note that typically there are two optical sensors installed on the trains at some displacement from each other for obtaining a stereo view, so distances can be measured.

The heading here contains a number of passive trackside structures which may be identified by the first sensor arrangement or the first localization stage respectively, namely a switch 56*a* on the left track of the heading, a switch 56*b* on the center track of the heading, a signal mast 56*c* between the left and central track, a signal mast 56*d* between the central and the right track, a power pole 57 between the central and the right track, and a bridge 56*e*. Note that possibly, the first localization stage may identify even more passive trackside structures, such as some more power poles or trees or some tracks as such.

In the map database of the on-board unit, schematically illustrated on the left of FIG. 4, the tracks as well as the locations of some of the passive trackside structures 56*a*-56*e* identified by the first localization stage are included, namely the bridge 56*e*, the two switches 56*a*, 56*b*, and the two signal masts 56*c*, 56*d*. Accordingly, the corresponding passive trackside structures 56*a*-56*e* identified with the first sensor arrangement may be allocated to the respective entries (registered/stored passive trackside structures) of the map database. Note that for each of the registered passive trackside structure 56*a*-56*e*, a georeferenced position as well as appearance characteristics are stored, such as the type of the signal, e.g. main-signal with velocity indication on top, the height above ground and the size of the black octagon and the black triangle. Identified appearance characteristics of the passive trackside structures measured by the first sensor arrangement have to sufficiently match the stored appearance characteristics in order to allow for a successful allocation. Note that the power pole 57, although identified by means of the first sensor arrangement, is not contained in the map database here, and therefore cannot be allocated; the same may be true for further passive trackside structures contained in the measured heading.

Figure 5:
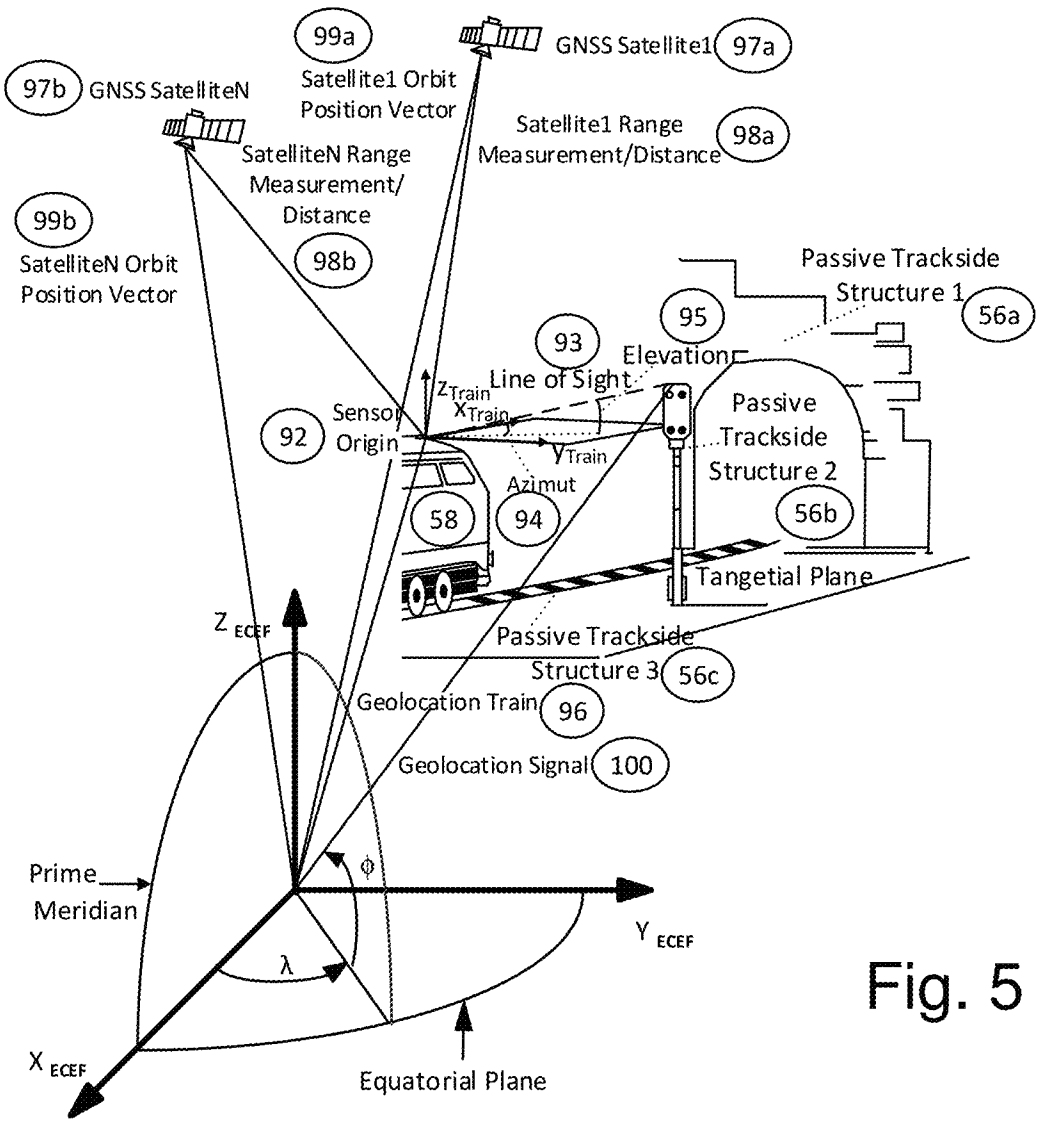
FIG. 5 shows a schematic illustration of a determining a first position information and a second position information, in accordance with the invention.

FIG. 5 illustrates the determination of first and second position information in accordance with the invention by way of example.

A train 58 travelling on a track comprises at its front a first and second sensor arrangement, not shown in detail here, which can for simplicity be assumed to be positioned at a location denoted here as sensor origin 92 on the train 58. In the example shown, the first sensor arrangement on the train 58 identifies three passive trackside structures 56*a*, 56*b*, 56*c*, here a tunnel (passive trackside structure 1) 56*a*, a railway signal mast (also simply called signal, passive trackside structure 2) 56*b*, and the track ahead 56*c*. Illustrated here for the signal 56*b* only, the first sensor arrangement measures a distance in the line of sight 93 of the sensor origin 92 to the passive trackside structure 56*b*, further an azimuth angle 94 (angle versus the $x_{train}$ direction/travelling direction of the train 58 in the horizontal $x_{train}$ $y_{train}$ plane, with $y_{train}$ being the horizontal direction perpendicular to $x_{train}$, and $z_{train}$ being perpendicular to $y_{train}$ and $x_{train}$, i.e. in the local coordinate system of the train 58), and further an elevation angle 95 (angle versus the plane $x_{train}$ $y_{train}$) of the passive trackside structure 56*b*. When knowing the geolocation 100 (georeferenced position, in the coordinate system of the earth, compare $X_{ECEF}$, $Y_{ECEF}$, $Z_{ECEF}$, ECEF=earth center earth fixed) of the signal 56*b* from the on-board map database, and further knowing the current distance (line of sight 93) and current angular position (azimuth angle 94 and elevation angle 95), the current geolocation of the train 58 or the sensor origin 92, respectively, may be calculated.

Further, the second sensor arrangement on the train 58 has contact to a plurality of satellites 97*a*, 97*b* orbiting in space; two satellites (here named satellite1 97*a* and satelliteN 97*b*) are illustrated only, for simplicity here. For each satellite 97*a*, 97*b*, the second sensor arrangement makes a range measurement, and calculates the respective distance 98*a*, 98*b* between the satellite 97*a*, 97*b* and the train 58 or the sensor origin 92. Further, for each satellite 97*a*, 97*b*, the orbit position vector 99*a*, 99*b* (georeferenced position) is known. Since the train 58 travels on known tracks only, two range measurements 98*a*, 98*b* and the geolocations 99*a*, 99*b* of the corresponding two satellites 97*a*, 97*b* are enough to determine the geolocation 96 of the train 58 then.

2. General Aspects of the Invention

On the Position Information and Sensor Data Cross-Check (Compare Ref. 88; 90, 38)

Preferably, a (first or second or consolidated) position information also comprises a consolidated train velocity. For this purpose, a sensor data set provided by a first or second sensor arrangement, or first or second sensor subarrangement, comprises train velocity, acceleration and attitude angles.

The sensor data is preferably checked for failures, in particular if the values are outside a projected error sensor model. In addition, different sensors, in particular the sensors of different sensor arrangements or localization chains, are cross-checked, e.g. the velocity of the radar sensor is compared to the velocity derived from the integrated acceleration of the inertial unit in terms of offset, drift and scale factor. In particular, the cross-check is performed between sensors that have diverse error characteristics. In addition the sensor data based on a filtered time series may be checked against the train dynamic motion model, for example the odometer slip minus the train motion exceeds the given threshold for a number of sequential time instances or a statistical average number of instances. The velocity confidence interval is preferably computed by worst case estimation of sensor models containing systematic component, velocity dependent component and statistic noise component.

On Satellite Based Position Determination and Signal Monitoring (Compare Ref. 88; 90; 18; 36)

The second localization stage receives satellite signals for a position determination of the train, typically including measuring ranges (or signal running times, respectively) to and receive navigation data from a plurality of satellites.

A data set of these ranging measurements is preferably checked for fault conditions with methods such as double difference of code measurement and carrier measurement between the two frequency measurements (L1 and L5) of subsequent samples. In addition, the data set may be checked for fault conditions by comparing the signal to noise reception level to a given minimum and accepting only satellites with a good signal reception and a minimum (general) satellite elevation and, if applicable, an elevation above a blocked elevation mask from the map data base. In addition, the data set may be checked for fault conditions by checking timely delta carrier measurements for excessive accelerations or steps by differentiating the phase measurements against the geometrical range plus satellite clock error and an estimate of the average residual of the term over all satellites. In addition, the data set may be checked for code carrier innovation failures by differentiating the current pseudorange with the projected pseudorange, which is calculated by the last measured pseudorange plus the delta carrier phase. The data set may also be checked for divergence failures by a hatch filter that smoothes the code difference minus the carrier difference of two consecutive epochs and averages this term over multiple receivers in order to compare the divergence to a threshold.

On Data Consolidation (Compare Ref. 30, 22, 19)

The invention proposes to obtain first or second position information (or first or second stage position subinformation) from different localization stages (or chains), and to make a data fusion to obtain consolidated (overall) position information (or consolidated first or second position information) of the train.

In general, data fusion (or consolidation) of a first position information and a second position information comprises, in the most simple case, a comparison of the difference of the first position information and the second position information and typically also considering statistical properties and quality indicators, and if the mutual deviation is smaller than a threshold level, the more accurate position information is used as consolidated position information. If the mutual deviation is at or above the threshold level and the protection level is below the alarm limit, the more reliable information (if no excess of any preceding alarm limit has been raised by this information) is promoted to consolidated position information. Note that the explanations given above and below apply to both consolidation of first and second position information, as well as to the consolidation of pieces of first or second stage position subinformation, in analogous way.

When using localization chains (compare e.g. FIG. 2*b*, items 73, 74, 79, 80), data fusion can be done in a first step with fusion of the position subinformation of each one localization stage separately (FIG. 2*b*, items 30 and 22) in order to obtain a (consolidated) first stage position information (FIG. 2*b*, item 52) and second stage position information (FIG. 2*b*, item 54), and in a second step (FIG. 2*b*, item 19) with fusion of the first and second position information to obtain the final consolidated position information. Alternatively, all position subinformation from all stages can commonly undergo data fusion (not further discussed here).

The first step of the data fusion, i.e. the fusion of (at least) two pieces of first stage position subinformation and further the fusion of (at least) two pieces of second stage position subinformation, may include applying an unscented Bayesian estimator in each case. The sensors (or their sensor data, respectively) of different localization chains should have orthogonal properties with respect to measurement principles and failure modes as embodiment of dissimilar sensors, preferably such that at least one localization chain in each localization stage should establish a valid position subinformation in any situation, and in particular wherein errors affecting one localization chain does not impair the other localization chain.

The data consolidation includes determining a difference between a position information output out1 and a second position information output out2, and that a fusion failure is detected if $$|out1-out2|>THFA,$$

with THFA: threshold for detection a fusion failure, in particular wherein THFA is determined with $$THFA=KFA*\sqrt{\sigma_{out1}^2+\sigma_{out2}^2}$$

with KFA: false alarm confidence, and $\sigma_{out1}$: standard deviation of out1, and $\sigma_{out2}$: standard deviation of out2, in particular wherein out1 and out2 are position subinformation from different localization chains of the same localization stage. If a fusion failure is detected, typically at least one of the position information outputs is barred from the data fusion for obtaining the consolidated position information.

Each geodetic processing chain (FIG. 2*b*, items 79, 80) is fed by one sensor providing absolute georeferenced position (e.g. given by GNSS sensors). In addition each chain has the input of a relative positioning information given by differential sensors such as inertial units, accelerometer, odometer or doppler radar. Sensors should be combined such that most orthogonality and independence is achieved. The GNSS sensor outputs/range measurements are based on code and carrier ranging to satellites, as well as additional information such as doppler or signal to noise ratio. The inertial measurement unit (IMU) (also called simply inertial unit) preferably includes a three axis gyroscope and accelerometer with high precision of angular orientation with real-time heading, pitch and roll orientation. Alternatively, a simple accelerometer or odometer (wheel impulse generator) or Doppler radar can be used as input in the fusion process. The benefits of using GNSS with an INS (INS=inertial navigation system) filter method are that the INS is calibrated by the GNSS signals and that the INS can provide position and velocity updates to fill in the gaps between GNSS positions. It allows to coast during areas of satellite blockage, such as tunnels or urban canyons with poor GNSS reception. The method works with various embodiments for the GNSS/sensor fusion filters, using the extended Kalman filter (EKF) or the unscented Kalman filter (UKF) for example. The EKF uses an analytical linearization approach to linearize the system, while the UKF uses a set of deterministically selected points to handle the nonlinearity.

On the Allocation of Passive Trackside Structures (Compare Ref. 14, 28; 29)

In the information of the first sensor arrangement, in particular of the optical imaging sensors, passive trackside structures are identified as positioning references containing as minimum information typically including but not limited to point ID, relative position with respect to the last track segment (e.g. track kilometre from track start and offset from track centreline) and geodetic position (e.g. latitude, longitude, height), shape, ID properties such as element type, size and quality indicators as well as measured information such as distances relative to the train and current angular positions relative to the train. The train uses its known position and determines extended structures such as tracks and other passive structures. All structures (56*a*-56*c*) are determined in a local train fixed coordinate system (compare FIG. 5, coordinates $x_{train}$, $y_{train}$, $z_{train}$) and are then transformed into an earth fixed coordinate system. The next ahead track segment is approximated in the 2D local plane as term e.g. spline or clothoid or polynomial. The height coordinate is approximated by the known train height and the inclination of the track as well as the train attitude (pitch angle). The track segment may be computed with the initial node coordinates, direction vector, term parameters such as segment length as per map data base format. The determined track segment shape allows to create a track segment or align the determined passive track structures to an existing track segment in the map data base.

3. Specific Aspects of the Invention

On Track-to-Train Messages (Compare Ref. 59*a*-59*c*) and Synchronization with a Supervision Map Data Base To ensure unambiguous train position determination, the knowledge of the train driven distance reference needs to be commonly identified on the train on-board map data base as well as on the map data base of the train supervising center (movement authority managing and supervision instance). These position references can be constituted by virtual reference points on the track, the track start, a track switch, a railway landmark, hence any point that can be uniquely identified at the trackside including rail infrastructure marks or rail traffic controlling infrastructure elements including signals and signs. Preferably, the method includes a data check for fault conditions by cross comparing the data sets of the diverse sensors as well as a comparison of the timely sequence of measurements.

The map data base checking mechanism proceeds based on two way exchange between a supervising instance and the train for map data base reference points. A track-to-train message (59*a*-59*c*) is used with the properties of the reference point (typically track kilometre from track start and offset from track centreline and geodetic position with latitude (lat), longitude (Ion), height, ID properties such as element type, size and quality indicators).

Figure 3:
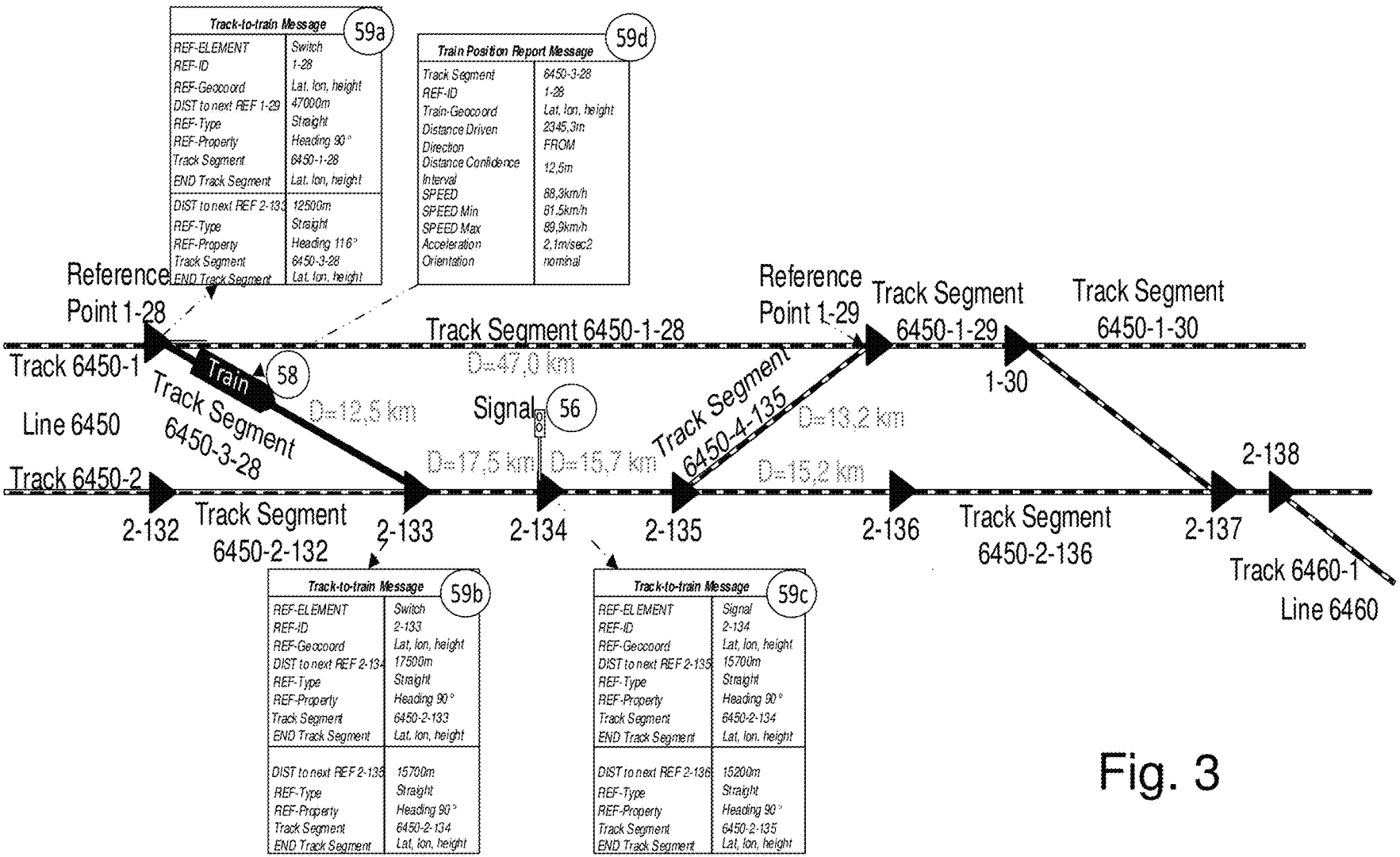
FIG. 3 shows a schematic illustration of a train route on a railway system, with reference points and corresponding track-to-train messages, in accordance with the invention.

FIG. 3 shows by way of example a route of a train 58 on a railway system, here comprising three tracks (6450-1, 6450-2 and 6460-1) for simplicity. The track segment 6450-3-28 assigned to the train 58 on the tracks is shown with a bolt line, and the other tracks are shown with dashed lines. The railway system includes a number of reference points, here reference points 1-28, 1-29 and 1-30 on the track 6450-1, reference points 2-132, 2-133, 2-134, 2-135, 2-136, 2-137 and 2-138 on the track 6450-2. Note that most of the reference points are located at switches here (for example reference point 1-29), another reference point 2-134 is located at a signal, and some reference points are at locations not further specified. FIG. 3 further illustrates the track-to-train messages 59*a*-59*c* that are delivered when the train 58 reaches a particular reference point. The safety design of the supervising instance includes typically a movement authorization, which may include at each change of track route a linking track-to-train message. An example of such a message is given in items 59*a*-59*c*, with at least data of reference point ID, coordinates, element type (e.g. straight element, curve left, curve right, etc.), distance for next reference ID and heading angle (also simply named heading). However message embodiments with various additional data items may work for the message exchange procedure as well. Such a message 59*a*-59*c* contains, apart from the identification of the triggering reference point, the details of next coming reference points. Those track-to-train message data items are used on-board to countercheck the driven route segment and to be aligned with the on-board train map. Nevertheless in case messages are missed, the train can drive autonomously guided by the on-board map. The train position is reported to the supervising instance by a message 59*d* containing the consolidated positioning output with at least the driven distance, Track segment ID, speed, and confidence intervals. If different routes are possible, the message 59*a*-59*c* includes details about the next reference point of each route here (for example, at ref. point 1-28, the next possible reference points are 1-29 and 2-133, depending on which track is chosen by the train at the switch of reference point 1-28). If only one route is possible, the message 59*a*-59*c* includes here details about the next one or more reference points on this one route (for example, at reference point 2-133, the next two upcoming reference points are 2-134 and 2-135). The details about a next reference point include, in particular, the distance from the present or previous reference point, a reference type indication, a reference property (i.e. in which direction the reference point is upcoming), and the geolocation of the end track segment, which basically corresponds to the location of the next reference point.

FIG. 3, for instance at top left, shows an example message 59*a* that can be extended for map element properties. The designated way is dynamically and incrementally given by the next track-to-train-message while the train 58 travels through the rail network, by indicating the next upcoming track segment IDs and the reference point IDs. At least each potential change of track route will be characterized by a map node reference point.

Preferably, the method includes a mechanism to countercheck the train on-board map data base with the train supervising (e.g. RBC) map data base data. For this purpose a node reference point exchange is set up wherein the next reference point or a sequence of node reference points are given from the train supervising center to the train and the train acknowledges the point or feeds back an alternative reference point.

Whenever the train passes such an environmental track point an event mark is given by the train on-board system. The embodiment of this event mark depends on the rail protection system as well on the specific train on-board implementation. It may be an electrical pulse, communication message or marker event data stream, which is output and time coded so that the map data base can associate the timely train position to this event. The train position needs to be corrected by the estimated train motion, in order to compensate the various delays such as processing delay and pulse detection delay. A window of expectation is opened, when the on-board train system is triggerable for reception of the next node reference event. The comparison of the in-advance given node reference locations and the passed node reference locations as well as the linking between them is used for positioning safety enhancement. Hence the sequence of node reference track points that the train passes can be compared with the train map data base.

Preferably, the method includes that the pattern of train movement is pointwise sequentially compared with the planned map data base route and any deviation is reported to the supervising instance. The method preferably includes that the linking is extended, not only including the distance between the points, but also including the distance of each point to the track reference or a given reference.

The train evaluates measured map data base objects (i.e. passive trackside structures) and detects discrepancies to the on-board train map data base objects, in terms of object position discrepancies, object structure (appearance characteristics) or type discrepancies. The train reports measurement discrepancies to the track-side infrastructure cloud for a background statistical analysis to detect and correct long term middle/low dynamic drifts. Map data base changes are consolidated and validated, given they are reported by several trains or by independent verification. The supervising reference map data base is updated under configuration control and released. As a last step, synchronization of the train map data base by the reference map data base is accomplished.

Figure 6:
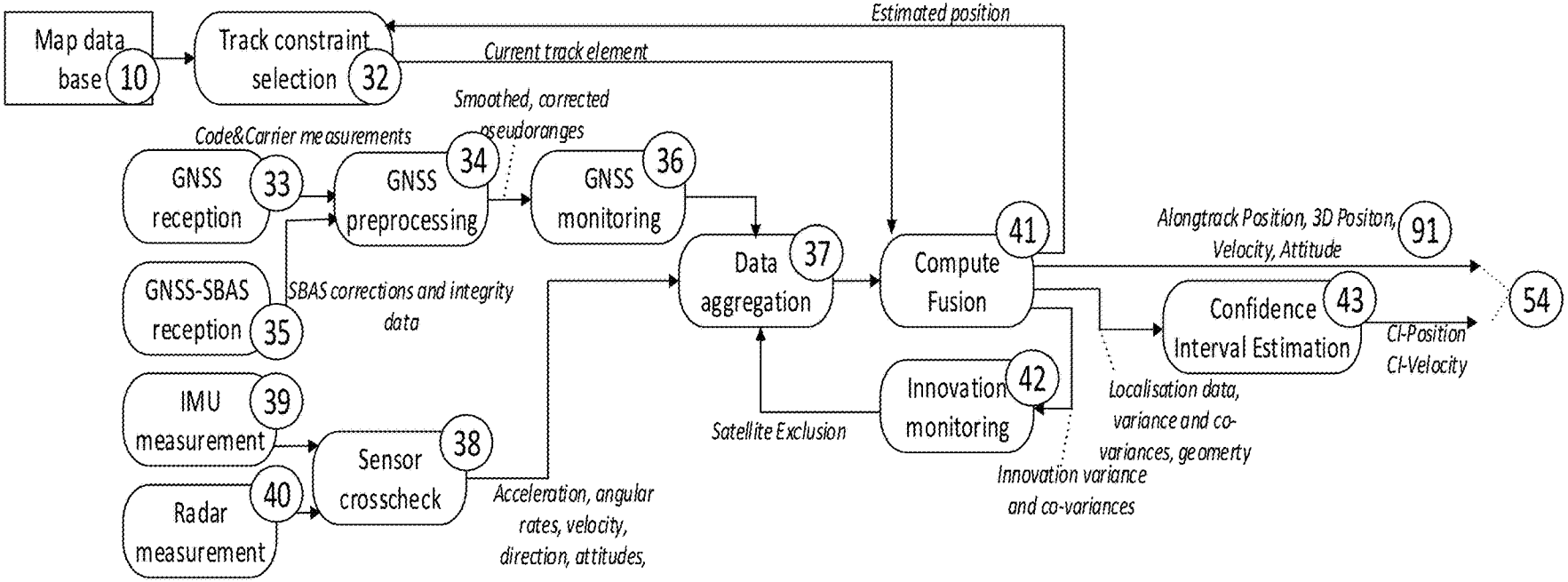
FIG. 6 shows a schematic illustration of fusion filter monitoring in a second localization stage, in accordance with the invention.

On Monitoring for Fault Cases and Avoiding Common Cause Failures in the Geodetic Localization Stage The inventive method can achieve a high level of safety, by applying a set of various monitoring techniques for known fault cases in order to maintain the achieved integrity level/hour, compare FIG. 6.

The by way of example illustrated method includes GNSS preprocessing 34 of measurement data. The code and carrier measurements from GNSS reception 33 are processed by application of correction and integrity data from GNSS-SBAS reception 35. One mitigation very useful for common cause failure mitigation is the usage of two dissimilar GNSS receivers as sensors. There are no common mode SW or hardware failures, given the receivers are designed and produced by different manufacturers. In addition, two different antenna positions on the train are preferably used, in order to have location independence. The multi-frequency access of the L1 and L5 frequency is the mitigation against ionospheric errors, because ionospheric divergences can be suppressed by the so called ion-free smoothing processing. In order to mitigate failures of the GNSS system (satellites, ground segment, ephemeris/almanac) that may lead to common erroneous behaviours of both receiver chains, at least different GNSS constellations (e.g. GPS/Galileo) are preferably used.

Part of the safety quality is derived from SBAS systems, which monitor the GNSS signals (compare GNSS monitoring 36). Differential corrections of the SBAS systems are applied, to correct satellite signal propagation and system inherent ranging errors. Thereby the real-time differential corrections of the geo satellite broadcast as well as the secondary channel differential correction (e.g. SISnet-internet or GSM channels) can be applied. Failures of atmospheric L1 propagation effects including ionospheric errors are compensated by the ionospheric error model messages of SBAS. Preferably, the method includes combining measures of SBAS algorithms with local GNSS monitoring and with independent control means of sensor innovation monitoring 42 and CI-bound (CI=confidence interval), i.e. using a confidence interval estimation 43. Sensor Innovation Monitoring 42 as means to detect sensor single errors by testing the difference between the observed measurement, and the corresponding Kalman filter prediction is preferably also part of the method.

As shown in FIG. 6, the method also includes inertial measurement unit measurements 39 and Radar measurements 40 and processing a sensor cross-check 38 with their data, and further a data aggregation 37 is performed for fusing the GNSS based information and the IMU and radar information such as velocity and acceleration. When computing a data fusion 41, innovation monitoring 42 is applied, in particular applying a satellite exclusion when satellite failures are detected, which is taken into account in data aggregation 37. Further, estimated position information is used to select the next track constraint 32 based on the tracks registered in the on board map data base 10; the determined current track element is taken into account in the computation of the data fusion 41. The information 91 from the fusion 41 and the results of the confidence interval estimation 43 together provide the stage 2 position information (or second position information) 54 of the second localization stage.

On GNSS Monitoring for Multipath Satellite Navigation Fault Cases (Compare Ref. 36)

For the inventive method, preferably multipath detection methods are applied, in order to mitigate the multipath threat. Preferably, a masking out of any multipath areas is applied, where satellites within a specific elevation are discarded for further processing, e.g. using a normal 5°-10° elevation and for multipath areas up to 30° elevation mask on both sides perpendicular to the track. The information of the dynamic multipath mask may be derived from the on-board data base. In addition, multipath error may be measured in real-time with GNSS receiver data such as correlator symmetry outputs. Non-line-of-sight multipath can be detected by the video/LIDAR online scanned data in order to exclude a non-line-of-sight multipath generating satellite ranging signal by calculating the relevant objects (e.g. walls/buildings next to the track) and the maximum path. The checks are typically done to the maximum of 150 m (or max correlation spacing multipath envelope) ahead and aside to check for any potential reflection objects and estimate the maximum geometrical multipath length. In addition, the map data base data may be extracted for additional aside objects, which are also put into the calculation to increase the confidence of the multipath error model.

On the 1D Track Constraint in Satellite Navigation and GNSS Monitoring (Compare Ref. 36)

The core principle of integrity monitoring is to perform consistency checks between multiple redundant position solutions of GNSS satellite ranging measurements for detection and exclusion of GNSS faulty measurements. In the inventive method, as enhancement of the 3D least square based GNSS solution, a 1D positioning may be used. This 1D algorithm is based on a principle different from the classical GNSS 3D location algorithm, because the map data base trajectory is already included as a constraint in the solution equation. Therefore only two satellite ranging observations are necessary to solve the unknowns of alongtrack position in the 1D position and receiver clock bias time. This allows achieving a solution integrity check with only 3 visible satellites, whereas for the classical solution 5 satellites are necessary as minimum. Hence any additional satellite observations can be used to achieve counterchecks with higher availability than existing Receiver Autonomous Integrity Monitoring (RAIM) based algorithms. This higher availability is particularly important in areas of impaired sky visibility or urban canyons.

Figure 7:
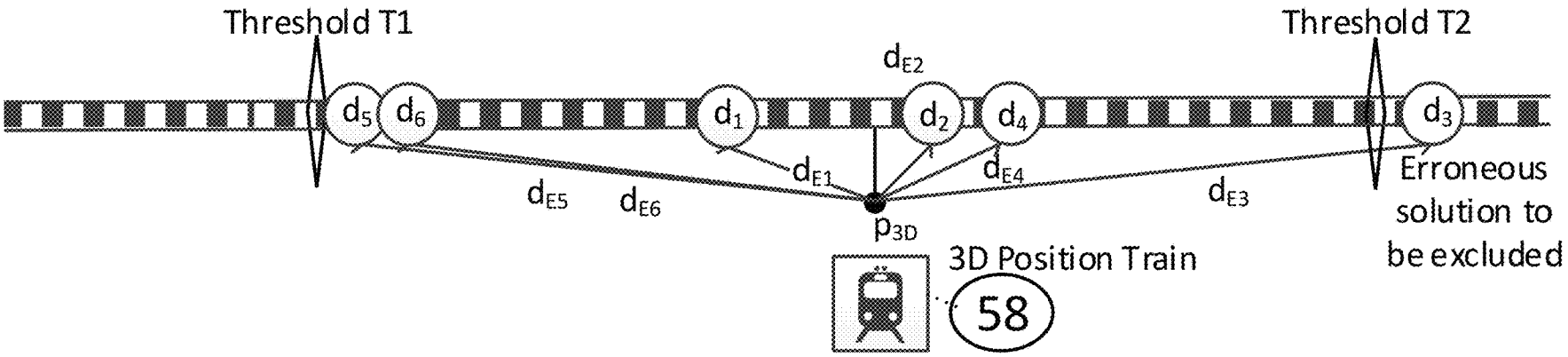
FIG. 7 shows a schematic illustration of a monitoring for fault cases of position determination using pairs of satellites, in accordance with the invention.

The 1D solution allows to generate a statistically significant number of permutations of two satellites with solutions, and the solution differences are used to generate statistics of the driven distance error, compare FIG. 7. The test statistic for a preferred variant of the inventive method can be determined by the distance of the 3D position of the train 58 (compare reference p in FIG. 7), where no map data base constraint is used, and the 1D solutions (compare train positions $d_1$-$d_6$ on the track in FIG. 7) of the permutations of 2 satellites. The test statistic for the nth satellite pair can be written as:

$d_{\varepsilon n}=|\vec{d}_n-\vec{p}_{3D}|$ where $\vec{d}_n$ is the driven distance vector constrained to the track and $\vec{p}_{3D}$, is the position vector resulting from a least square solution. The test statistic $d_{\varepsilon n}$ can be compared to the 1D protection level (threshold) as described below. If the distance $d_{\varepsilon n}$ is smaller than the threshold (compare threshold limits T1, T2 in FIG. 7), the set of satellites is considered as valid (as is the case for $d_1$, $d_2$, $d_4$, $d_5$, $d_6$ in FIG. 7). In case the test statistics is greater than the threshold (i.e. do is outside the limits of T1 and T2, as is the case for $d_3$ in FIG. 7), the set is excluded from further use in the subsequent processing steps.

On the 1D Confidence Interval Estimation (Compare Ref. 43)

The inventive method preferably includes the estimation of the confidence interval (43) of the on-track position (location) and velocity, wherein a 1D linear protection level equation with a sum of a variance terms to represent the nominal monitoring error and a bias term is used. Hence instead of a standard deviation σ1, which needs inflation for the Gaussian distribution to bound the true distribution, it is safer to add a bias term, which is calibrated for each satellite. The 1D confidence for the fault free H0-hypothesis case is established by the model equation below, which represents an estimation, based on actual satellite geometry and measurement quality:

$$sCi_{GNSS,H0} = K_{FF_EGNOS}\cdot\sigma_{CHAIN_M} < K_{FF}\cdot\sqrt{\sum_{i=1}^{N} s_{alongtrack,i}^2\sigma_{ff,i}^2} + \sum_{i=1}^{N}|s_{alongtrack,i}b_{ff,i}|$$

where:

$K_{FF_EGNOS}$=Fault free confidence factor as per apportioned integrity $\sigma_{CHAIN_M}$=standard deviation of the fault free positioning solution of the chain $s_{alongtrack}$=partial geometrical derivate of the position error in along track projection $\sigma_{ff,i}$=standard deviation of the ith satellite error (fault free case)

$b_{ff}$=nominal bias bound of the ith satellite error (fault free case), static value from calibration.

The method preferably includes that the along track confidence interval is the root mean square of the projected pseudorange noise errors $\sigma_{ff,i}$ over the two ranging sources used to compute the 1D solution, whereas for this alongtrack solution only 2 satellites are needed to calculate the position from the map data base-based parametric track element constraint, in order to find the driven distance on the track.

The method preferably includes that the S matrix, containing the weighted geometry projections. The method is applicable with a satellite based weighting factor in the W matrix or an equal weighting for all satellites, where weighting matrix W turns to the unit matrix 1, the projection matrix simplifies to $$\overline{S} = \begin{bmatrix} s_{alongtrack,SV1} & s_{alongtrack,SV2} \\ s_{t,SV1} & s_{t,SV2} \end{bmatrix} = (\overline{G}^T\cdot\overline{W}\cdot\overline{G})^{-1}\cdot\overline{G}^T\cdot\overline{W} = \overline{G}^{-1} \text{ for } \overline{W} = \overline{1}.$$

The method preferably includes to extract the expected DOP value (DOP=dilution of precision) via the expectation of the geometrical error $\Delta\hat{\varepsilon}$ $$E[\Delta\hat{\varepsilon}\Delta\vec{\varepsilon}^T]_{pos}=E[\Delta\varepsilon_{Geometry}^2]=s_{alongtrack,SVi}^2=(G^TG)^{-1}$$

which results as:

$$s_{alongtrack,SVi}^2=\sqrt{2(G_{11}^{-1})^2}=\sqrt{2}G_{11}^{-1}.$$

The CI (CI=confidence interval) is expressed then as:

$$sCI = K_{ff}\cdot s_{alongtrack,SVi}\cdot\sigma_{ff,i} = 6\cdot\sqrt{2}\,G_{11}^{-1}\sigma_{ff,i} + \sum_{i=1}^{2}|s_{alongtrack,i}b_{ff,i}|$$

For the single frequency, the sigma estimation model is given by $$\sigma_{ff,i}^2=\sigma_{flt,i}^2+\sigma_{tropo,i}^2+(\sigma_{RX_noise,i}^2+\sigma_{MP,i}^2+\sigma_{IONO,i}^2)$$

and the dual frequency version uses $$\sigma_{ff,i}^2=\sigma_{flt,i}^2+\sigma_{tropo,i}^2+6.76\cdot(\sigma_{RX_noise,i}^2+\sigma_{MP,i}^2)$$

where $\sigma^2_{ff,i}$=the fault-free or nominal total error variance of ith satellite, $\sigma^2_{flt,i}$=model variance of residual error after EGNOS fast, long term and range rate corrections, $\sigma^2_{tropo,i}$=model variance of residual error, $\sigma^2_{RX_noise,i}$=measured user receiver noise of ith satellite, assuming L1 and L5 have the same noise, $\sigma^2_{MP,i}$=multipath error of ith satellite, assuming L1 and L5 have the same error.

Alternatively for a data fusion with multiple sensor measurements, the sigma values from the covariance matrix of the weighted least-square solution can be used. The variance of each measurement is computed as the explicit sum of the variances of the various contributions of error (noise, residual of the various SBAS corrections, multipath).

If the GNSS receiver is able to measure the standard deviation of the measurements noise of the ranging source, it is the preferred solution, otherwise a model $\sigma_{RX_noise}$ (elevation, i) dependent of the relevant parameters such as antenna gain and elevation may be used.

The confidence interval $dCi_{GNss,H1}$ under the faulted condition is similar except that it adds a faulted bias term $B_{GNSSRXi}$, which is calculated by the delta of the two receiver single differences. Always the maximum confidence interval is used. As per design, 2 GNSS receiver chains are used, resulting in one fault hypothesis H1, representing the fact that any one GNSS receiver is faulted.

$$dCi_{GNSS,H1} = K_{md}\cdot\sqrt{\sum_{i=1}^{2} s_{alongtrack,i}^2\sigma_{ff,i}^2} + \sum_{i=1}^{2}|s_{alongtrack,i}b_i| + \max_i|s_{alongtrack,i}B_{GNSSRX,i}|$$

$$dCi_{GNSS} = \max(sCi_{GNSS,H0}, sCi_{GNSS,H1} msCi_{GNSS,\sigma 1D})$$

The bias term $B_{GNSSRX,i}$ can be calculated by the long term difference of the two single difference range values of the GNSS receivers $$B_{GNSSRX,i}=|\mathrm{Mean}(SD_{GNSSRX1,i}-SD_{GNSSRX2,i}|)$$

For each satellite, the single distance measurements used in this combination will be obtained from the same ephemeris data.

$$SD_{GNSSRXj,i}=|R_{j,i}^{ENU}|-PR_{Smoothed,j,i}-t_{GNSSRXclk,j}$$

where:

$R^{ENU}$=train antenna to satellite line of sight vector magnitude $PR_{smoothed}$=smoothed pseudorange $t_{GNSSRXclk}$=receiver clock correction i=satellite designator j=GNSS receiver designator The 1D alongtrack standard deviation of the various valid 1D solution permutation, after position exclusion, can be calculated with the following equation as $$\hat{\sigma}_{1D_alongtrack}=\sqrt{\frac{1}{N_{1D}-1}\left(\sum_{i=1}^{N_{1D}} d_{alongtrack,i}^2-\frac{1}{N_{1D}}\left(\sum_{i=1}^{N_{1D}} d_{alongtrack,i}\right)^2\right)}$$

$$sCi_{GNSS,\sigma 1D}=K_{1D}\cdot\hat{\sigma}_{1D_alongtrack}.$$

On Predicting Upcoming Passive Trackside Structures, Limiting a Field of Interest, Track Selection and Passive Trackside Structure Identification Environmental map data base based localization, in accordance with the invention, can be done in particular by video and/or LIDAR input data. Preferably, the method uses two dissimilar imaging sensors (preferably in first sensor subarrangements), such as LIDAR in order to overcome the unavailability situations of Video (e.g. fog, night, snow). If the recognized objects in the sensor data sets are matching close enough and the same orientation is recognized by video image and LIDAR, they may be managed as the same object and kept/put into the memory. For example, the LIDAR backscatter intensity can be combined with the camera images by a 2 dimensional correlation of both images and by superimposing pixels of both images.

With a Kalman filter supported prediction step the potential object location including the region of interest can be predicted between the last cycle and current cycle. The confidence estimation is applied: the number of matches between the objects in memory and the current objects over the number of cycles since the object first appeared. If metric is below a threshold, objects are removed from the memory.

In more detail, for a track selection feature, the video based image processing techniques can be used. Rescaling and calibrating the optical properties for optimal contrast and luminosity as well as averaging over subsequent frames in order to remove the image noise and to highlight the rails may be included as a processing step.

With a priori information from the map the expected field of view can be searched for matching patterns of expected structure shape and size. The field of interest is chosen such that all possible tracks from the map data base plus an option of additional track will be in the field of interest. Preferably, the method includes using several regions of interests in order to split a track curve into several segments. Each rail is captured in a bounding box with translocated size+/−gauge/2 horizontal width. The height size of the first segment is variable, depending on the curvature or the heading of the rail. In case the rail is straight ahead, the vertical size will be chosen as a fraction of the field of view distance bottom to vanishing point (e.g. quarter). In case of rail curvature it will be chosen as a fraction of this vertical height such that it can be linearized with a given epsilon error that characterizes the displacement between an assumed clothoid and a linearized segment. Given a rail is detected within the region of interest and the rail is also piercing the upper part of the bounding box, the size of the next upper bounding boxes will be determined based on the law of perspective of equidistant shapes mapped to the vanishing point. Otherwise the region of interest is enlarged and the process is repeated until a rail is detected.

Pixels outside the field of interest are cleared. For pixels inside this field of interest, image processing operations such as edge detection are used with a thresholding for suppressing unwanted pixel elements. Otherwise template matching is used, with configurable template apriori knowledge (e.g. tracks are parallel with standard gauge). After this processing step the pixels that represent the tracks are extracted as the environment is masked out. The video frames are processed with image rectification to compensate for camera focal shift, orientation and installation offset called inverse perspective mapping. The number of matching pixels divided by the number of total template pixels can be compared against a given threshold, in order to accept or reject the result of the matching process.

Various embodiments can be used to find the best fitting polynomial in a pixel cloud that represents the track. Linear track assumption can be done, given the horizontal split of the region of interest is small enough, otherwise curved polynomials or splines have to be used. The idea that all possible track patterns based on parallelism and orientation can be seen from a train borne headed camera and LIDAR is preferably used as a search pattern. For the selection of the central track (where the train is on) the installation geometry of the optical sensors is taken into consideration. The polynomials can be used for map data base matching and track identification of the central track as well as possible side tracks by correlating the map data base information with the polynomials identified in the image. At the end of the process the track ID of the central used track, coming from the map data base, and the geocoded map data base information of the track polynomials can be associated. The goal of train position track selection can be achieved by this method.

For the rail environment various significant rail-landmark objects such as signals, signs, catenary pylons, platforms, switches or other rail objects can be used. Note that in addition or alternatively, non-rail landmarks may be used, too. Landmarks (or passive trackside structures) are stationary features which can unambiguously be re-observed and distinguished from the environment. As a step in the inventive method, a feature extraction of the video or LIDAR image identifies relevant attributes in order to characterize an object or a scene. There are various embodiments of the feature extraction methods that can be used.

As part of the method landmark object classification may be used to identify an object in the scene based on preceding feature extraction. The position of the landmark points of interest must be given in the train on-board map data base. The step of data association is that of matching measured LIDAR (and/or video) landmarks with the map data base. To improve integrity the timely measurement history may be used in the association validation. The pair (map data base landmark and measured landmark) must be the same landmark as on the historic tracking sequence. The fact that measured data frames are more frequent than the train movement results in that the scene does only have a minor change with respect to the image content, what can be used to enhance the detection robustness. In addition the a priori knowledge of the field of interest from the on-board map data base can be used to enhance the probability of detection of an object. For example a pre-signal or a signal is expected at the right side of the relevant track in a given distance, that is in compliance with the rules and regulations of the railway operator as well as given properties such as shape and colour. Also the sequence of annunciation that is used for train drivers can be fed into the a priori knowledge of detection (for example annunciation signs preceding a signal). The usage of these rules results in a higher detection probability.

After accumulating landmark map data base position and measured position, the determination of train motion and localization can be performed. The method preferably includes locating the train by computing the vector of landmark position and the measured LIDAR (or stereo video) range distance and bearing to the objects. Other embodiments may be chosen, based on an extended Kalman filter, where the landmark distances and visual odometry velocity are combined in filter states and used for positioning.

On Track Selection Based on Candidate Heading Angles (Compare Ref. 30)

The situation of tracks extracted from the imaging sensors including parallel tracks, switches, track curvature and other characteristics may be used to initially match with the map data base track structure in order to select or confirm the used track. In addition, the estimated track from the train map data base is preferably checked on the basis of heading angle and the movement sequence, expressed in heading angle change over time. The track element type and properties, known from the map data base, allows counterchecking with the wayside measured properties. The inventive method preferably compares the heading angle and heading angle change of a 3D solution with the heading angle given by the map data base. Hereby the position on the track must be roughly known (e.g. by distance measured via odometry against a well-known reference point and an according confidence interval). Autocorrelation function or matching function between the measured trajectory and the candidate map data base geometry is computed for candidate map data base locations. Hence the track heading angle, heading angle change and the track bending can be used as signature properties for the matching method. The track pattern associated with the highest correlation or match is then considered as the candidate of choice for the actual vehicle movement path and in turn allows validating the train track.

What is claimed is:

1. A method for safely determining a position information of a train on a track, the method comprising the steps of:

providing an on-board system of the train identifying trackside structures, wherein the trackside structures comprise passive trackside structures which are passive in their identification by the on-board system, wherein the on-board system stores a map database in which georeferenced locations and appearance characteristics of the passive trackside structures are registered;

determining, by the on-board system, appearance characteristics, current distances relative to the train and current angular positions relative to the train of the passive trackside structures by means of a first sensor arrangement of a first localization stage of the on-board system, wherein the first sensor arrangement comprises one or more optical imaging sensors, being a video sensor and/or a LIDAR sensor, and wherein a feature extraction of a video or LIDAR image identifies relevant attributes in order to characterize an object or scene, and wherein the first localization stage allocates passive trackside structures measured by the first sensor arrangement to passive trackside structures registered in the map database using the determined appearance characteristics and the registered appearance characteristics;

deriving a first position information about the train from a comparison of determined current distances and current angular positions and the registered locations of allocated passive trackside structures by the first localization stage;

deriving a second position information about the train from satellite signals determined by a second sensor arrangement of a second localization stage of the on-board system;

wherein the first position information and the second position information undergo a data fusion, resulting in a consolidated position information about the train; and wherein the consolidated position information about the train includes a 1D confidence interval along its track.

2. The method according to claim 1, wherein the consolidated position information also comprises a consolidated train velocity, and wherein the first sensor arrangement and/or the second sensor arrangement comprises one or a plurality of an inertial unit, a Doppler radar system or an odometer, and wherein the first position information and the second position information comprise a first train velocity and a second train velocity respectively, and that the data fusion includes determining the consolidated train velocity.

3. The method according to claim 2, wherein the consolidated position information also includes a corresponding velocity confidence interval and velocity angle components such as up, north, east.

4. The method according to claim 1, wherein the first sensor arrangement further comprises one or a plurality of inertial unit, radar system or odometer.

5. The method according to claim 1, wherein the second sensor arrangement comprises one or more GNSS-SBAS RX sensors, and wherein the second sensor arrangement further comprises one or a plurality of inertial unit, radar system or odometer.

6. The method according to claim 1, wherein the first localization stage comprises at least two independent localization chains with separate first sensor subarrangements, with each localization chain providing an independent set of appearance characteristics, current distance and current angular position for a respective passive trackside structure, wherein for each set, a separate allocation to registered passive trackside structures is done and an independent first stage position subinformation is derived, and wherein the second localization stage comprises at least two independent localization chains with separate second sensor subarrangements, with each localization chain providing an independent second stage position subinformation about the train.

7. The method according to claim 6, wherein each chain includes a monitoring function that detects chain failure modes.

8. The method according to claim 6, wherein the data fusion comprises a first step with fusion or consolidation of the position subinformation of each one localization stage separately in order to obtain the first and second position information, and a second step with fusion of the first and second position information to obtain the consolidated position information.

9. The method according to claim 1, wherein the passive trackside structures used in position determination are chosen such that the allocation the of passive trackside structures measured by the first sensor arrangement to the registered passive trackside structures is accomplished with a confidence above a predefined threshold value, wherein for passive trackside structure recognition an initial position is used to select from the map database expected ahead structures to be recognized, with an expected structure type and an expected angular position as well as an expected distance, which are used, together with a recent history of allocated passive trackside structures, as a matching constraint for allocating the measured trackside structures to the registered trackside structures, and whereas in case no specific trackside structures are expected or have been tracked in the recent history, generic passive structures that are stored as templates are used to be matched.

10. The method according to claim 1, wherein the on-board system reports the consolidated position information as train position report message to a supervision in-stance allocating track routes to trains, wherein the supervision instance uses a supervision map database for said allocating track routes to trains, and wherein the on-board system map database is regularly synchronized with the supervision map database with respect at least to its content necessary for determining position of the train.

11. The method according to claim 10, wherein after the consolidated position information of the train has been determined, the train evaluates locations of passive trackside structures sensed by the first sensor arrangement, and determines discrepancies between the locations sensed by the first sensor arrangement and an expected locations according to the map database stored in the on-board system, and reports determined discrepancies above a threshold to the supervision instance, wherein the supervision instance collects reported determined discrepancies from a plurality of trains, and wherein in case a determined discrepancy referring to a passive track-side structure is reported by a plurality of trains, the supervision instance updates its supervision map database after a successful validation process, and the map database stored in the on-board system is synchronized with the supervision map database.

12. The method according to claim 1, wherein sensor data of the first sensor arrangement and/or second sensor arrangement and/or first position information and/or second position information and/or first stage position sub-information and/or second stage position subinformation undergo a monitoring for fault cases, including a check against expected value ranges from statistical error models.

13. The method according to claim 12, wherein also a crosschecking of first and second stage position subinformation of each stage is done.

14. The method according to claim 12, wherein sensor data of the second sensor arrangement undergo said monitoring for fault cases in satellite measurements, namely multipath errors, ionospheric propagation errors and/or satellite defects, by comparing code and carrier measurements or by comparing satellite measurements against projected value innovations.

15. The method according to claim 12, wherein said monitoring comprises consistency checks of the second localization stage between redundant satellite ranging measurements, and wherein a track trajectory included in the map database stored in the on-board system is used as a constraint, such that an alongtrack 1D position information of the train is obtained from a pair of 2 satellites, and consistency of a multitude of pairs of 2 satellites are checked.

16. The method according to claim 15, wherein the monitoring applies an autonomous integrity monitoring type algorithm.

17. The method according to claim 1, wherein the first localization stage uses information from the on-board map database in order to predict an upcoming passive trackside structure, and in order to choose accordingly a limited field of interest out of the sensor data of the first sensor arrangement in order to facilitate finding said passive trackside structure.

18. The method according to claim 17, wherein the first localization stage uses information from the on-board map database in order to predict an upcoming passive trackside structure by means of a Kalman filter.

19. The method according to claim 1, wherein in case the map database stored in the on-board system shows a number of tracks in a defined near vicinity of the train, then a heading angle and heading angle change of the train as measured by the first sensor arrangement is compared with a number of candidate heading angles and heading angle changes of the train calculated by means of the map database for the train being on each of said number of tracks, wherein the candidate heading angle and heading angle change with the best match with the heading angle and heading angle change measured by the first sensor arrangement is determined, wherein the consolidated position information is used to indicate one of the tracks of said number of tracks on which the train is travelling, and wherein in case that said track indicated by the consolidated position information is identical with said track having the best match, the consolidated position information is validated, and else invalidated.

20. The method according to claim 1, wherein the passive trackside structures comprise pre-existing structures not installed for the method for safely determining the position information of the train on the track, the passive trackside structures comprising rail infrastructure elements, signals, signs, buildings, train stations, bridges, signal masts, crossing roads, traffic signs and/or switches.

21. A method for safely determining a position information of a train on a track, the method comprising the steps of:

providing an on-board system of the train identifying trackside structures, wherein the trackside structures comprise passive trackside structures which are passive in their identification by the on-board system, wherein the on-board system stores a map database in which georeferenced locations and appearance characteristics of the passive trackside structures are registered;

determining, by the on-board system, appearance characteristics, current distances relative to the train and current angular positions relative to the train of the passive trackside structures by means of a first sensor arrangement of a first localization stage of the on-board system, wherein the first localization stage allocates passive trackside structures measured by the first sensor arrangement to passive trackside structures registered in the map database using the determined appearance characteristics and the registered appearance characteristics;

deriving a first position information about the train from a comparison of determined current distances and current angular positions and the registered locations of allocated passive trackside structures by the first localization stage;

deriving a second position information about the train from satellite signals determined by a second sensor arrangement of a second localization stage of the on-board system;

wherein the first position information and the second position information undergo a data fusion, resulting in a consolidated position information about the train;

wherein sensor data of the first sensor arrangement and/or second sensor arrangement and/or first position information and/or second position information and/or first stage position sub-information and/or second stage position subinformation undergo a monitoring for fault cases, including a check against expected value ranges from statistical error models; and wherein said monitoring comprises consistency checks of the second localization stage between redundant satellite ranging measurements, and wherein a track trajectory included in the map database stored in the on-board system is used as a constraint, such that an alongtrack 1D position information of the train is obtained from a pair of 2 satellites, and consistency of a multitude of pairs of 2 satellites are checked.

22. A method for safely determining a position information of a train on a track, the method comprising the steps of:

providing an on-board system of the train identifying trackside structures, wherein the trackside structures comprise passive trackside structures which are passive in their identification by the on-board system, wherein the on-board system stores a map database in which georeferenced locations and appearance characteristics of the passive trackside structures are registered;

determining, by the on-board system, appearance characteristics, current distances relative to the train and current angular positions relative to the train of the passive trackside structures by means of a first sensor arrangement of a first localization stage of the on-board system, wherein the first localization stage allocates passive trackside structures measured by the first sensor arrangement to passive trackside structures registered in the map database using the determined appearance characteristics and the registered appearance characteristics;

deriving a first position information about the train from a comparison of determined current distances and current angular positions and the registered locations of allocated passive trackside structures by the first localization stage;

deriving a second position information about the train from satellite signals determined by a second sensor arrangement of a second localization stage of the on-board system;

wherein the first position information and the second position information undergo a data fusion, resulting in a consolidated position information about the train; and wherein in case the map database stored in the on-board system shows a number of tracks in a defined near vicinity of the train, then a heading angle and heading angle change of the train as measured by the first sensor arrangement is compared with a number of candidate heading angles and heading angle changes of the train calculated by means of the map database for the train being on each of said number of tracks, wherein the candidate heading angle and heading angle change with the best match with the heading angle and heading angle change measured by the first sensor arrangement is determined, wherein the consolidated position information is used to indicate one of the tracks of said number of tracks on which the train is travelling, and wherein in case that said track indicated by the consolidated position information is identical with said track having the best match, the consolidated position information is validated, and else invalidated.

23. A method for safely determining a position information of a train on a track, the method comprising the steps of:

providing an on-board system of the train identifying trackside structures, wherein the trackside structures comprise passive trackside structures which are passive in their identification by the on-board system, wherein the on-board system stores a map database in which georeferenced locations and appearance characteristics of the passive trackside structures are registered;

determining, by the on-board system, appearance characteristics, current distances relative to the train and current angular positions relative to the train of the passive trackside structures by means of a first sensor arrangement of a first localization stage of the on-board system, wherein the first sensor arrangement comprises one or more optical imaging sensors, being a video sensor and/or a LIDAR sensor, and wherein a feature extraction of a video or LIDAR image identifies relevant attributes in order to characterize an object or scene, and wherein the first localization stage allocates passive trackside structures measured by the first sensor arrangement to passive trackside structures registered in the map database using the determined appearance characteristics and the registered appearance characteristics;

deriving a first position information about the train from a comparison of determined current distances and current angular positions and the registered locations of allocated passive trackside structures by the first localization stage;

deriving a second position information about the train from satellite signals determined by a second sensor arrangement of a second localization stage of the on-board system;

wherein the first position information and the second position information undergo a data fusion, resulting in a consolidated position information about the train;

wherein the on-board system reports the consolidated position information as train position report message to a supervision in-stance allocating track routes to trains, wherein the supervision instance uses a supervision map database for said allocating track routes to trains, and wherein the on-board system map database is regularly synchronized with the supervision map database with respect at least to its content necessary for determining position of the train; and wherein after the consolidated position information of the train has been determined, the train evaluates locations of passive trackside structures sensed by the first sensor arrangement, and determines discrepancies between the locations sensed by the first sensor arrangement and an expected locations according to the map database stored in the on-board system, and reports determined discrepancies above a threshold to the supervision instance, wherein the supervision instance collects reported determined discrepancies from a plurality of trains, and wherein in case a determined discrepancy referring to a passive track-side structure is reported by a plurality of trains, the supervision instance updates its supervision map database after a successful validation process, and the map database stored in the on-board system is synchronized with the supervision map database.

* * * * *